United States Patent [19]

Egerer

[11] Patent Number: 5,044,048

[45] Date of Patent: Sep. 3, 1991

[54] COMBING MACHINE

[76] Inventor: Josef Egerer, Beim Biengarten 2b, D-854o, Schwabach, Fed. Rep. of Germany

[21] Appl. No.: 542,507

[22] Filed: Jun. 25, 1990

[30] Foreign Application Priority Data

Jul. 4, 1989 [DE] Fed. Rep. of Germany ..... 3921868

[51] Int. Cl.[5] ..... D01G 19/10; D01G 19/16

[52] U.S. Cl. ..... 19/216

[58] Field of Search ..... 19/215, 216, 217

[56] References Cited

U.S. PATENT DOCUMENTS

| | | | |
|---|---|---|---|
| 1,425,059 | 8/1922 | Schleifer | 19/217 |
| 1,778,873 | 10/1930 | Sundberg . | |
| 1,799,066 | 3/1931 | Schleifer | 19/217 |
| 4,564,979 | 1/1986 | Ramasco | 19/215 |

FOREIGN PATENT DOCUMENTS

| | | | |
|---|---|---|---|
| 595493 | 3/1934 | Fed. Rep. of Germany . | |
| 2845245 | 4/1980 | Fed. Rep. of Germany . | |
| 16288 | 5/1971 | Japan | 19/215 |

*Primary Examiner*—W. C. Reynolds
*Assistant Examiner*—John J. Calvert
*Attorney, Agent, or Firm*—Browdy and Neimark

[57] ABSTRACT

A combing machine comprises a rotating combing roller with a comb segment, a feed device for a sliver to be combed, a gripper arrangement disposed in the vicinity of the comb segment which opens and closes in a manner coordinated with the passing movement of the comb segment and which holds the sliver while the latter is being combed by the comb segment, and a draw-off device which moves the combed sliver away. For reducing the mass to be moved and for the improvement of the combing quality a transfer gripper arrangement (14) is provided which is movable back and forth between the gripper arrangement (1) and the draw-off device (2) in a manner coordinated with the rotating motion of the comb segment (8) and which, after passage of the comb segment (8) and combing of the protruding tuft (22) and the opening of the gripper arrangement (1), grips the combed sliver (22) and holds it in such a way that during the next pass of the comb segment (8) the rear portion of the sliver (22*a*), looking in the direction of movement, is combed by the comb segment (8), and which then hands off the sliver 922) to the draw-off device (2).

6 Claims, 5 Drawing Sheets

COMBING MACHINE

FIELD OF THE INVENTION

The invention relates to a combing machine comprising a rotating combing roller with a comb segment, a feed device for a sliver or group of fibers to be combed, a gripper arrangement disposed in the vicinity of the comb segment which opens and closes in coordination with the passing movement of the comb segment and which holds the sliver while the latter is being combed by the comb segment, and a draw-off device which moves the combed sliver away.

BACKGROUND OF THE INVENTION

Such combing machines are used to remove natural impurities contained in cotton fibers or wool fibers and to align the fibers of the sliver or group of fibers parallel to each other. To accomplish this, a prepared sliver is clamped between the jaws of the gripper arrangement in such a way that a certain portion of the length of the fibers extends beyond the front of the jaws in the form of a so-called tuft. This tuft is combed and thus cleaned by means of the comb segment, equipped with a set of needles or teeth, of the combing roller. The draw-off device as a rule consists of two oppositely rotating rollers which grip the combed tuft and move it on.

So as to be able to draw the partially cleaned fibers with the rollers of the draw-off device out of the jaws of the gripper unit, either the comparatively heavy draw-off device must move linearly or in the form of a section of a circle in relation to the tuft held between the jaws of the gripper device or, in the reverse way, the gripper device must be moved towards the stationary draw-off rollers. See, for example, German published patent application DE-05 28 45 245. With 200 to 350 comb movements per minute usually required, and in view of the great masses to be moved, this results in a great amount of dynamic agitation of the entire combing machine and limits its working speed.

In conventional combing machines there is the additional problem that when the combed fibers are drawn off by the counter-rotating draw-off rollers, up to 50% of the fiber length has not been cleaned by the circular comb because it was clamped between the jaws of the gripper device during the combing process. In order to also clean this portion of the fibers as thoroughly as possible, in the conventional way these fibers are drawn through a fixed comb disposed ahead of the draw-off rollers. Such a fixed comb, consisting of one or at best two rows of needles, naturally does not have the cleaning effect of a comb segment covered with thousands of tips.

SUMMARY OF THE INVENTION

Based on the foregoing, it is an object of the invention to reduce, the dynamic loads by a reduction of the mass moved in the course of the combing process and, also to assure that the portion of the sliver, which in the past had only been insufficiently combed by the fix comb, is also subjected to intensive cleaning by the circular comb.

This object is attained in accordance with the invention by means of a transfer gripper arrangement which is movable back and forth between the gripper arrangement and the draw-off device in a manner coordinated with the rotating motion of the comb segment and which, after passage of the comb segment and combing of the protruding tuft and the opening of the gripper arrangement, grips the combed sliver and holds it in such a way that during the next pass of the comb segment the rear portion of the sliver, looking in the direction of movement, is combed by the comb segment, and which then hands off the sliver to the draw-off device.

Such a transfer gripper arrangement can be made considerably lighter than the conventional movable gripper arrangement. Its weight may only be about one-tenth of such a conventional gripper arrangement. Thus the transfer grippers take over the function of transferring the combed part of the sliver from the conventional gripper arrangement to the conventional draw-off rollers, which results in providing these two arrangements in stationary form and in the consequent avoidance of the usual dynamic problems which occur during acceleration and braking of these relatively heavy masses. Perhaps even more important, by means of the invention a considerable improvement in the combing quality is attained, because the portion of the sliver which up to now had not been combed is now also being combed by the rotating circular comb, the combing effect of which naturally is considerably better than that of the conventionally used stationary fix combs. However, no additional comb segment or other combing device is required for attaining this additional combing effect, since only one and the same comb segment is used over a larger portion of its circular path, so that during each rotation it first combs the front portion of the sliver, looking in the direction of transport, and immediately thereafter the rear portion of the sliver, the front end of which had been combed during the previous pass of the comb segment.

The transfer gripper arrangement is disposed for linear movement. It is preferably pivotably disposed between the gripper arrangement and the draw-off arrangement. The opening and closing movements of the jaws of the transfer gripper arrangement may be derived from its pivot motion. The pivot motion, in turn, is derived from the rotary motion of the comb segment. Because of this motion no separate drive mechanisms are required for the movement of the transfer gripper arrangement, and its opening motion and movement coordinated with the rotary motion of the comb segment is assured in a mechanical manner.

In connection with the invention it is preferred that at least one protruding row of needles is disposed in a first jaw of the transfer gripper arrangement, which is in contact with a recess of the other jaw when the gripper arrangement is closed. By means of this construction a parallel alignment and an additional combing effect in the manner of the fixed comb is achieved when the sliver is pulled off by the draw-off rollers.

In this connection it is also advantageously provided for the jaws of the transfer gripper arrangement to have protrusions which are lug-shaped in cross section and on which the actual retaining lip is formed.

In an alternate embodiment it is provided for the transfer gripper arrangement to comprise two abutting transport rollers which are driven in opposite directions, where the opening motion of the transfer gripper arrangement is achieved by means of the transport state of the rollers and the closing motion by the closed state of the rollers.

Advantageously the rollers are resiliently pressed against each other by spring arrangements in order to achieve a sufficient holding effect at the time the rear portion of the sliver is combed.

BRIEF DESCRIPTION OF THE DRAWING

The invention will be described in detail below by means of preferred embodiments in connection with the drawings, wherein.

DETAILED DESCRIPTION OF EMBODIMENTS

Figure 1:
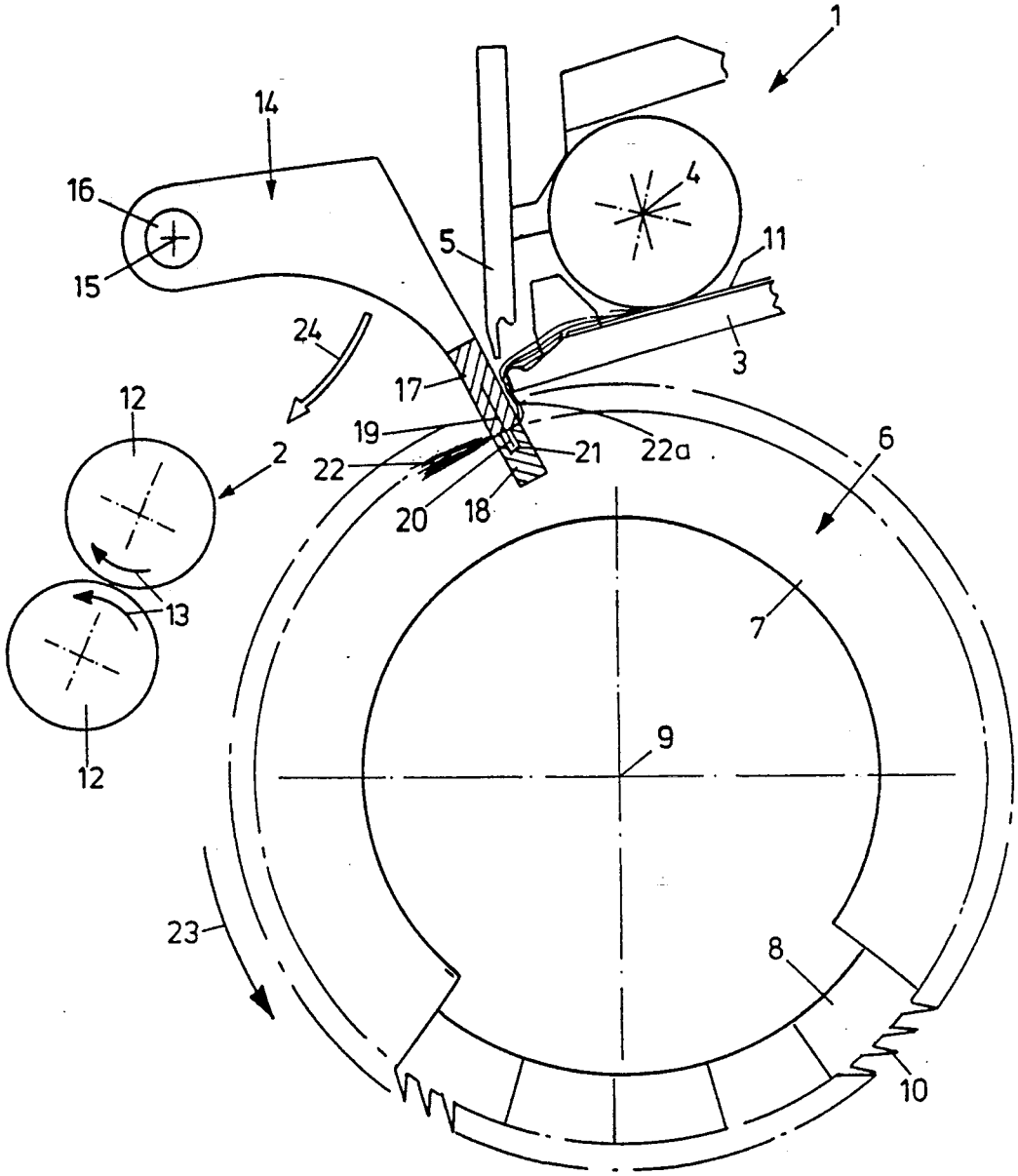
FIGS. 1 to 4 are schematic, partially cut lateral views of the gripper arrangement, transfer gripper arrangement, draw-off device and circular comb in various work phases without the respective drive elements.

As noted above, combing machines of the type under consideration are known for example from German Published, Non-examined patent application DE-OS 28 45 245 and the references cited therein. However, the combing machine in accordance with the present invention and described below essentially differs in that the gripper arrangement 1 as well as the draw-off device 2 are stationary.

Thus, a combing machine in accordance with the present invention comprises a gripper arrangement 1 with a stationary lower jaw 3 and an upper jaw 5 disposed pivotably around a pivot bearing point 4.

A circular comb 6, comprising a combing roller 7 and a comb segment 8 disposed thereon, are provided below the gripper arrangement 1, the circular comb 6 being rotationally driven on a rotary axis 9. The comb segment 8 is provided with a set of combing pins or teeth, in the exemplary embodiment with a set of sawteeth 10. A sliver 11 consisting of fibers to be combed is fed in a known manner by a feed device, not shown in detail, to the gripper arrangement 1. The draw-off device 2 comprises two draw-off rollers 12 which are rotatingly driven in opposite directions as shown by the arrows 13.

The coordinated movement of the gripper (1) and comber (6) and the opening and closing of the gripper mechanism is described in detail in U.S. Pat. No. 4,945,611 to Reiter, filed Aug. 29, 1989, and based on corresponding German application 38 31 020 published as laid-open application on Mar. 15, 1990.

A transfer gripper arrangement 14 is provided between the gripper arrangement 1 and the draw-off device 2 and is pivotably seated around a pivot bearing axis 15 on a shaft 16.

The transfer gripper arrangement comprises an upper jaw 17 and an lower jaw 18, a row of needles 19 being fixed in the upper jaw 17, the needle points 20 of which are in contact with a recess 21 on the jaw 18. The combing machine shown in the drawing operates in a known matter in such a way that the gripper arrangement 1 closes and holds the sliver 11, while a tuft 22 which is to be combed projects when the comb segment 8 with the set of teeth 10 passes, so that the tuft 22 is combed. Then the gripper arrangement 1 opens and the combed sliver or the protruding tuft 22 can be moved on.

Figure 2:
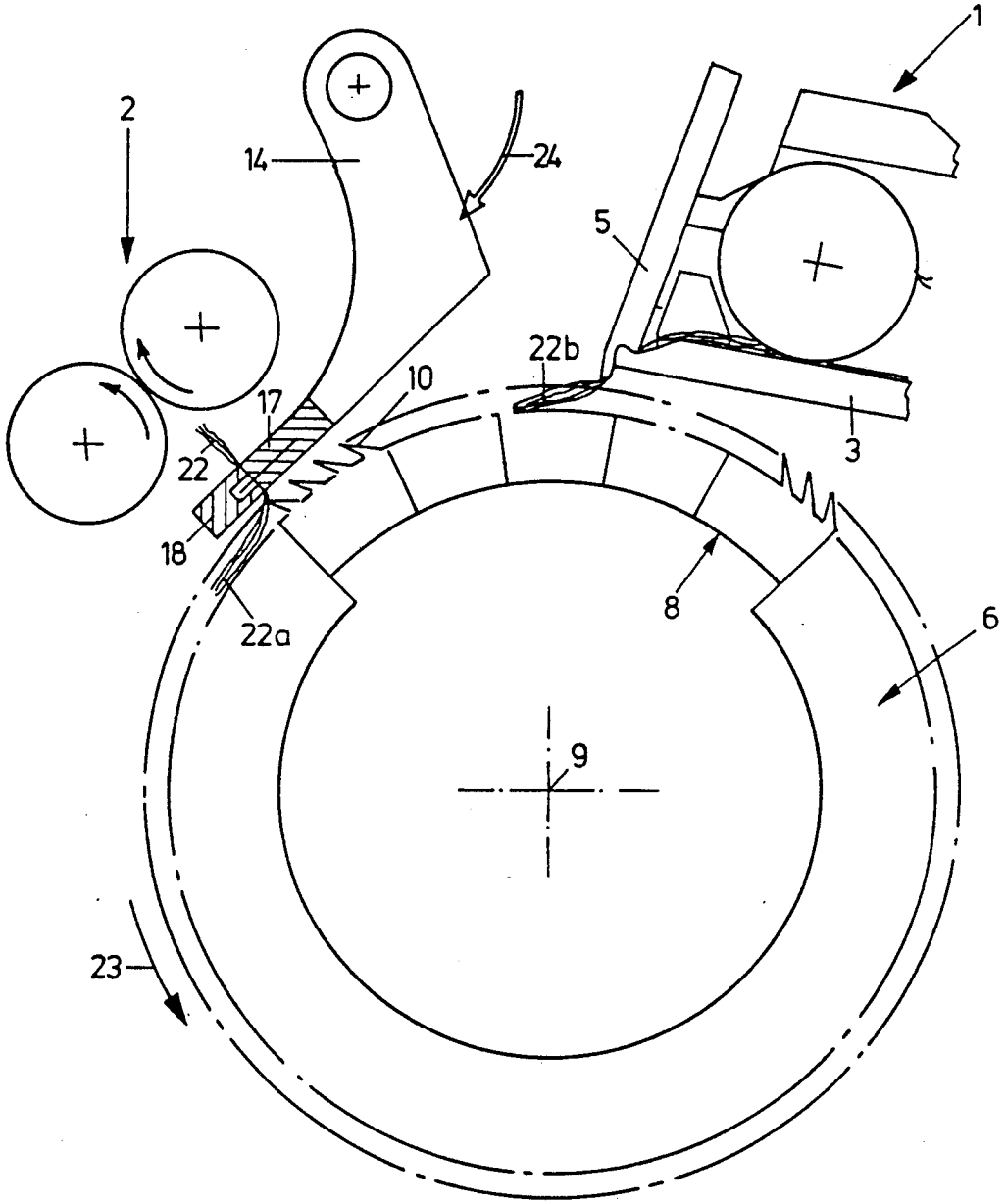

The exceptional feature of the device in accordance with the invention lies in the transfer gripper arrangement 14. The mode of operation of this transfer gripper arrangement 14 becomes clear by the comparison of FIGS. 1 to 4. A movement phase is illustrated in FIG. 1 where the comb segment 8, turning in the direction of the arrow 23, has passed and combed a front portion of a first tuft 22. After this, the gripper arrangement 14 has then gripped the first tuft 22 with its jaws 17 and 18 and performs a pivotal movement around the pivot axis 15 in the direction of the arrow 24. In this position the already combed front portion of first tuft 22 points upwards, as shown in FIG. 2, while the rear portion **22*a* of the first tuft which was previously held by the gripper arrangement 1 and had not been combed, now points downward into the path of motion of the set of teeth 10 of the comb segment 8. Now, when the comb segment 8 passes, first a second tuft 22*b*, which has been advanced and is held by the gripper arrangement 1 between the upper jaw 5 and lower jaw 3, is combed and immediately thereafter the uncombed rear portion 22*a*** of the previously combed sliver section is combed.

Figure 3:
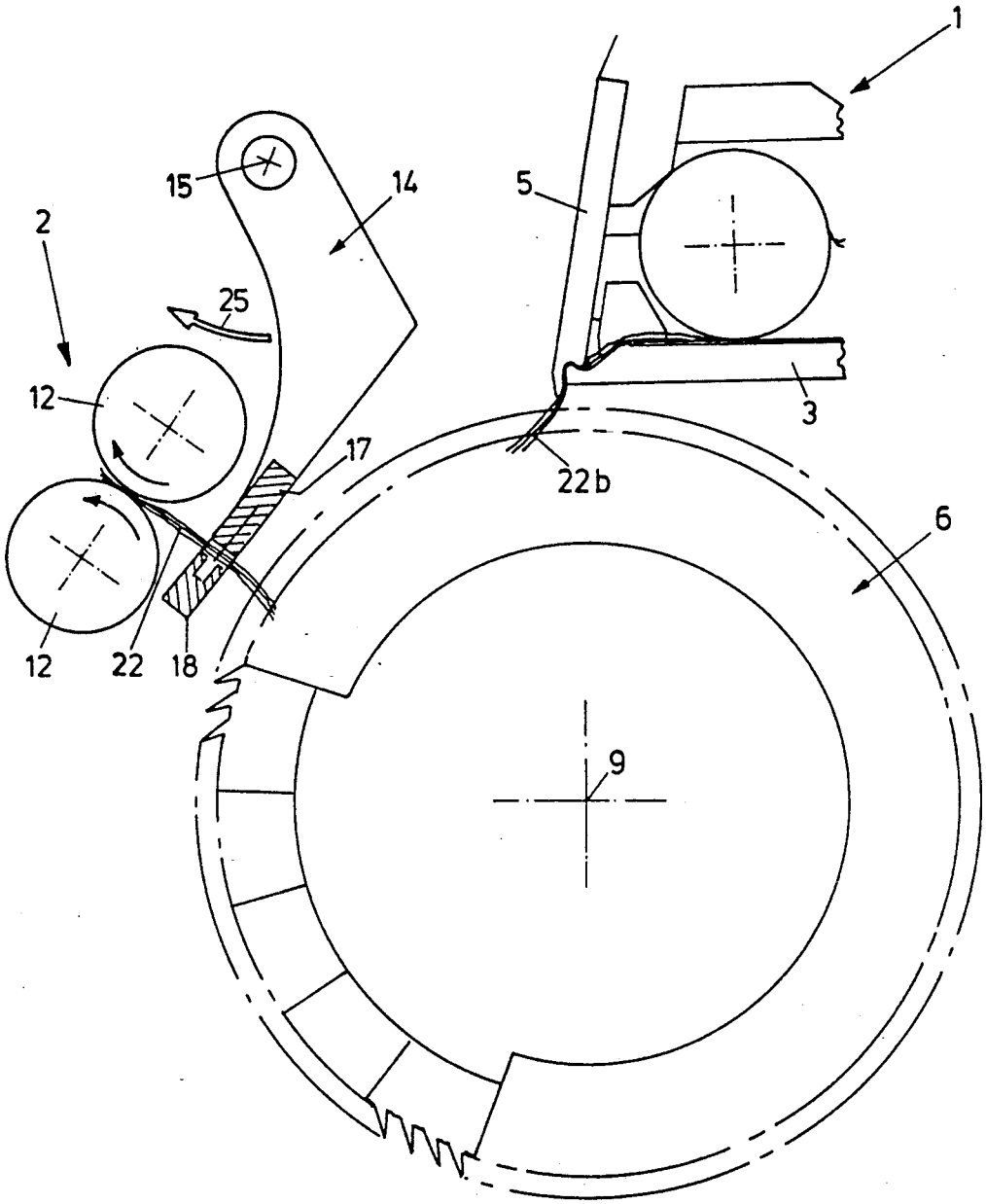

As becomes clear from FIG. 3, the transfer gripper arrangement 14 then moves for a short distance around the pivot axis 15 in the direction of the arrow 25, so that the first tuft 22 can be gripped by draw-off rollers 12 and drawn off. To allow the drawing-off of the first tuft 22, the transfer gripper arrangement 14 opens, i.e. the jaw 18, the lower one in FIG. 3, moves away from the upper jaw 17.

Figure 4:
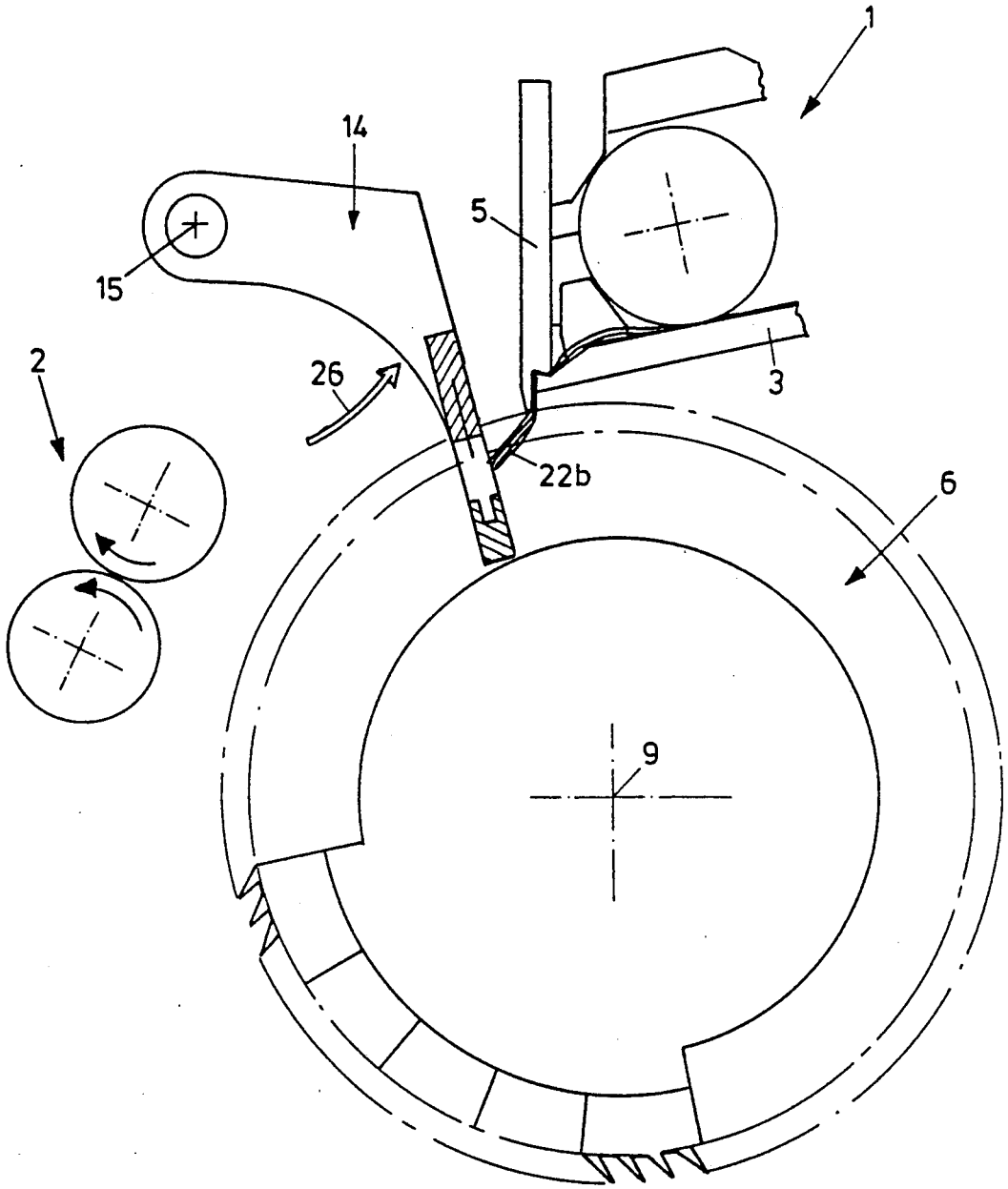

Next the gripper arrangement 14 pivots back in its opened state around the pivot axis 15 in the direction of the arrow 26 as shown in FIG. 4, and grips the second tuft **22*b* which is still held between the lower jaw 3 and upper jaw 5 of the gripper arrangement 1, which then opens, so that the combing operation repeats itself with the position shown in FIG. 1**.

Figure 5:
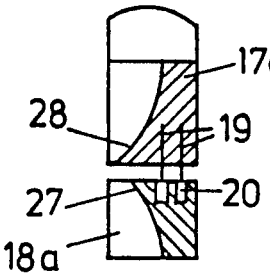
FIG. 5 is a section through the jaws of the transfer gripper arrangement.
Figure 6:
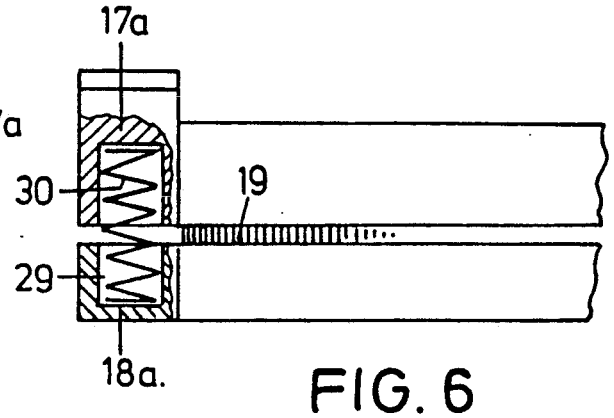
FIG. 6 is a section turned by 90° with respect to FIG. 5.

The jaws 17, 18 of the transfer jaw arrangement 14 are shown in detail in FIGS. 5 and 6. In this embodiment two rows of needles 19 are provided in the upper jaw **17*a*, which are in contact with corresponding recesses 20 in the closed position. The jaws 17, 18 have lug-like protrusions 27, 28, between which a retaining lip for the sliver is formed. A helical spring 30 disposed in a recess 29 pushes the jaws 17, 18** apart and in this way provides the opening movement. The closing movement is derived from the pivot movement via a cam drive, not shown.

Figure 7:
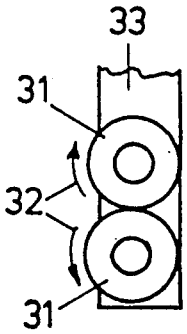
FIG. 7 is a section through a further embodiment of the transfer gripper arrangement.
Figure 8:
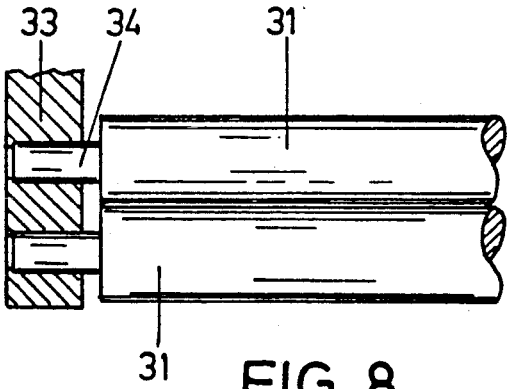
FIG. 8 is a section turned by 90° in respect to the view of FIG. 7.

An alternative embodiment of the jaws of the transfer arrangement 14 is shown in FIGS. 7 and 8. In this embodiment the jaws are formed by rollers 31 which can be rotatably driven in opposite directions in the direction of the arrows 32. FIG. 8 shows how the rollers 31 are supported in bearing elements 33 by means of bearing sections 34. The drive movement of the rollers 31 is controlled in such a way that they are stopped if a sliver is to be held between them, corresponding to the closed position of the jaws 17, 18, while they are rotatably driven in the direction of the arrows 32 if the gripper arrangement 14 is to assume an "open" position, where the portion of the sliver located between the rollers 31 is moved on.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a combing machine comprising a rotating combing roller with a comb segment, a feed device for a sliver to be combed, a gripper arrangement disposed in the vicinity of the comb segment which opens and closes in coordination with the passing movement of the comb segment and which holds the sliver while a front portion of the latter is being combed by the comb segment, and a draw-off device which moves the combed sliver away, a single transfer gripper arrangement (14) which is movable back and forth between the gripper arrangement (1) and the draw-off device (2) in a manner coordinated with the rotating motion of the comb segment (8) and the combing of said front portion of said sliver and the opening of the gripper arrangement (1), said single transfer gripper arrangement then gripping the comb sliver (22) and holding said sliver in such a way that during the next pass of the comb segment (8) the rear portion of said sliver (22), looking in the direction of movement, is combed by the comb segment (8), said single transfer gripper arrangement (14) then handing off said sliver (22) to the draw-off device (2), the improvement comprising:

said single transfer gripper arrangement (14) being pivotably supported between said gripper arrangement (1) and said draw-off device (2);

said gripper arrangement (1) having jaws, one jaw of said jaws mounted in a stationary position in the vicinity of said comb segment, a second jaw of said jaws pivotally mounted to open and close said jaws, said jaws holding said sliver for combing of said front portion when said jaws are closed, said single transfer gripper arrangement holding said sliver for combing of said rear portion after said jaws open and before transferring a combed sliver to said draw-off device.

2. A combing machine in accordance with claim 1, wherein the opening and closing motions of the jaws (17, 18) of the transfer gripper arrangement (14) are derived from its pivot motion.

3. A combing machine in accordance with claim 1, wherein the pivot motion of the transfer gripper arrangement (14) is derived from the rotary motion of the comb segment (8).

4. A combing machine in accordance with claim 1, characterized in that the transfer gripper arrangement (14) comprises two abutting transport rollers (31), which are driven in opposite directions, and where the opening motion of the transfer gripper arrangement (14) is realized by the transport state of the rollers (31) and the closing motion by the closed state of the rollers (31).

5. A combing machine in accordance with claim 1, wherein, in a first jaw of the transfer gripper arrangement (14), at least one projecting row of needles (15) is disposed, which are in contact with a recess (20) of the respectively other jaw (18) when the transfer gripper arrangement (14) is closed.

6. A combing machine in accordance with claim 5, the aws (17, 18) of the transfer gripper arrangement (14) have protrusions (27, 28), which are lug-like in cross section and on which the actual retaining lips are formed.

* * * * *